US005617799A

United States Patent [19]

Kaczorowski

[11] Patent Number: 5,617,799

[45] Date of Patent: Apr. 8, 1997

[54] MARKING MATERIAL-SPRAYING ANTI-THEFT SYSTEM

[76] Inventor: Paul Kaczorowski, 80 Bay St. Landing, Staten Island, N.Y. 10301

[21] Appl. No.: 411,544

[22] Filed: Mar. 28, 1995

[51] Int. Cl.[6] ..... E05G 1/00

[52] U.S. Cl. ..... 109/29; 109/20; 109/25

[58] Field of Search ..... 109/20, 25, 29, 109/33–36; 150/134

[56] References Cited

U.S. PATENT DOCUMENTS

| | | | |
|---|---|---|---|
| 1,890,589 | 12/1932 | Reynolds | 109/29 X |
| 3,096,940 | 7/1963 | Burleigh | 109/29 X |
| 3,564,525 | 2/1971 | Robeson et al. | 109/29 X |
| 3,991,688 | 11/1976 | Winters | 109/20 X |
| 4,202,445 | 5/1980 | Porter | 109/29 X |
| 4,391,203 | 7/1983 | Millar | 109/29 X |
| 4,722,435 | 2/1988 | Mareels et al. | 109/25 X |
| 4,799,435 | 1/1989 | Boutroy | 109/25 |
| 4,852,502 | 8/1989 | Klingberg et al. | 109/25 |
| 4,867,076 | 9/1989 | Marcone | 109/20 |
| 4,884,507 | 12/1989 | Levy | 102/293 |
| 5,156,272 | 10/1992 | Bouchard et al. | 109/29 X |
| 5,196,828 | 3/1993 | Keniston | 109/29 X |
| 5,208,085 | 5/1993 | Pace | 109/25 X |
| 5,293,990 | 3/1994 | Masakayan | 109/20 X |
| 5,406,896 | 4/1995 | Jacobson | 109/29 |

FOREIGN PATENT DOCUMENTS

| | | | |
|---|---|---|---|
| 2053949 | 4/1993 | Canada | 109/25 |
| 473471 | 3/1992 | European Pat. Off. | 109/29 |
| 2445429 | 8/1980 | France | 109/29 |
| 2305483 | 4/1974 | Germany | 109/29 |
| 2442548 | 3/1976 | Germany | 109/20 |
| 232 | 1/1894 | United Kingdom | 109/29 |
| 997162 | 7/1965 | United Kingdom | 109/25 |
| 1446711 | 8/1976 | United Kingdom | 109/20 |

OTHER PUBLICATIONS

Amtrak "Travel Mall Holiday 94" Catalogue, (1994), p. 71.
Speed (20th Century Fox 1994).

*Primary Examiner*—Suzanne Dino
*Attorney, Agent, or Firm*—Brumbaugh, Graves, Donohue & Raymond

[57] ABSTRACT

A marking material-spraying mechanism is incorporated into a protected article, such as a wallet, handbag, laptop computer case, or briefcase. When a thief who has stolen the protected article opens a closure within the article the mechanism operates to spray the marking material on the thief. The mechanism is automatic, and does not require activation during a robbery.

17 Claims, 3 Drawing Sheets

MARKING MATERIAL-SPRAYING ANTI-THEFT SYSTEM

BACKGROUND OF THE INVENTION

The present invention relates generally to marking material-spraying anti-theft devices, and, more particularly to anti-theft systems which spray a marking material such as a dye or odorant on a thief who opens a particular closure in a protected article.

Conventionally, marking material-spraying anti-theft devices are activated by a timing means, such as in dye grenades for adding to bags of money during bank robberies. Additionally, it is known to use hand-held devices, which are activated by a victim, to spray dye on a thief. None of these devices is useful as a safe, effective method for identifying a thief after a mugging or purse-snatching. Devices with timers are useful only when they can be activated by a victim before a thief absconds with the stolen article. Such timer devices are problematic because the victim may not have a chance to activate such a device, and in doing so, the victim risks retaliation by an alert thief. Hand-held spray devices also invite retaliation by the thief because the thief must be present when such devices are used.

For the foregoing reasons, there is a need for a marking material-spraying anti-theft device which can be used to mark a thief and the stolen goods after the thief has left the victim, and the victim is thus out of danger. There is also a need for a marking material-spraying anti-theft device which is automatic, and does not require dangerous action by the victim during a robbery to be effective.

SUMMARY OF THE INVENTION

There is provided, in accordance with the invention, an improved marking material-spraying anti-theft device that does not possess the shortcomings of the prior art, and offers the advantages of being safe for the victims to use because it operates automatically. The device has a closure, which is preferably a part of the protected article, i.e. a wallet, purse, etc. The owner knows not to open the closure because doing so actuates an activator which causes marking material to spray out of the protected article. Since a thief is likely to search the stolen protected article for valuables after leaving the victim, the victim does not risk retaliation by a thief who is marked with the dye.

More particularly, the marking material-spraying anti-theft device of the present invention comprises a container which may contain means for directing the marking material spray toward the thief. This means for directing the marking material may comprise one, or preferably several, aperture sections designed to break open when sufficient pressure develops within the container. A marking material is positioned within the container such that when an overpressure inside the container causes the aperture sections to break, the marking material sprays out of the broken aperture sections.

Upon activation, an overpressure generating means, such as an explosive or compressed gas vessel, supplies the necessary overpressure. The force exerted by the overpressure then breaks open the aperture sections, and sprays out the marking material. An activating means triggers the overpressure generating means when a thief opens a closure within the article while searching for valuables.

The overpressure generating means must be powerful enough to force the dye to spray out of the container onto the thief. However, it must not be powerful enough to rupture the container in places other than the weaker aperture sections. At least one of the aperture sections should be positioned to direct the spraying dye through the now-opened closure towards the thief.

The present invention may be employed to advantage in personal carriers such as wallets, purses, briefcases, handbags, personal computer carrying cases or other articles which have compartments for receiving items of value.

These and other features, aspects, and advantages of the present invention will become better understood with reference to the following description, appended claims, and accompanying drawings.

BRIEF DESCRIPTION OF THE DRAWINGS

FIG. 7(*a*) shows the switch as a combination of several subswitches connected in series. FIG. 7(*b*) shows the switch as a combination of several subswitches connected in parallel. FIG. 7(*c*) shows the switch as a combination of several subswitches connected in series and in parallel.

DESCRIPTION OF THE PREFERRED EMBODIMENTS

Figure 1:
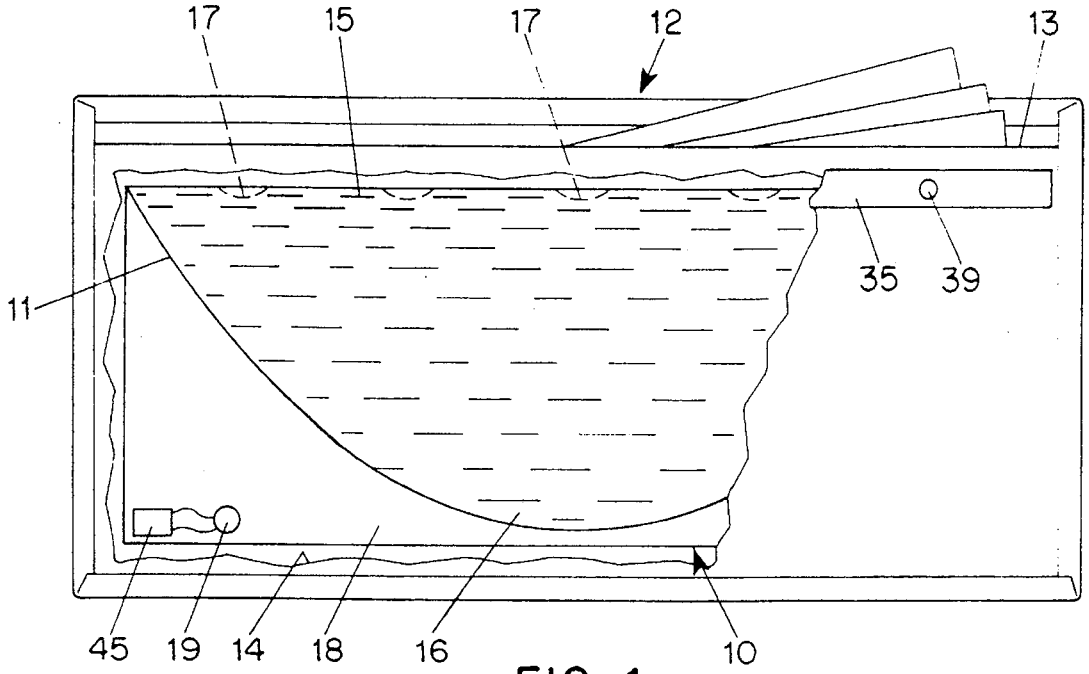
FIG. 1 is a diagrammatic side elevational view of a protected wallet according to the invention with parts broken away to show an anti-theft device.
Figure 3:
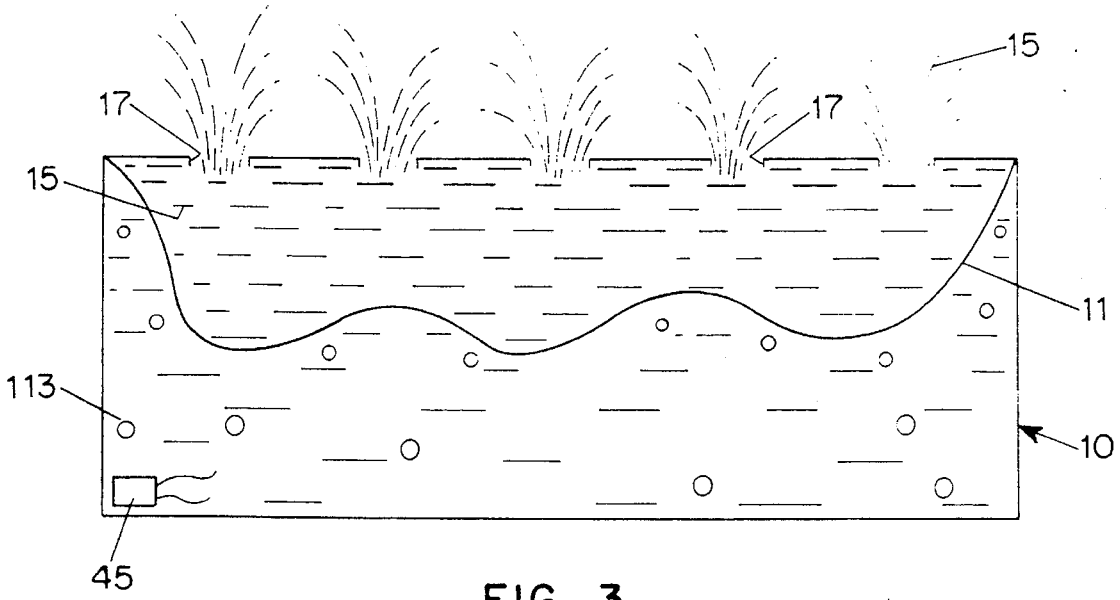
FIG. 3 is a diagrammatic side elevational view of the wallet of FIG. 1, after detonation.

In FIG. 1, a container 10 has a flexible bladder 11 containing a marking material in the form of a dye 15. The container 10 is shown situated in a compartment or pocket 14 of a wallet 12, which has a closure 35. The wallet has a first compartment 13 used in the ordinary way to contain, e.g., currency as indicated. The composition of the container 10 in the wallet's second compartment 14 is not important so long as it is strong enough to only break at one or more weaker aperture sections 17 when the explosive 19, detonates. The shape of the container 10 is also unimportant so long as the weaker aperture sections 17 can be located such that dye material 15 spraying from the container 10 (as shown in FIG. 3) will be directed toward a person activating the device.

Moreover, while a flexible container 10 with a flexible interior bladder 11 is contemplated in FIG. 1, it will be recognized that various alternative arrangements may suffice, such as a rigid container shaped to fit the protected item and/or an inflexible piston driven by an explosive or compressed air to force the marking material from the container.

In one preferred embodiment of the invention, a detonating circuit 45 is electrically connected with the explosive 19. A flexible bladder 11 divides the container into (i) a first container section 16 containing the dye 15; and (ii) a second container section 18 containing the explosive 19. The first container section 16 which contains the dye 15, also defines the weaker aperture sections 17. These weaker aperture sections 17 may be formed by stretching or heating a thermoplastic material, forming the container 10 so that it is considerably weaker at the aperture sections 17.

Figure 2:
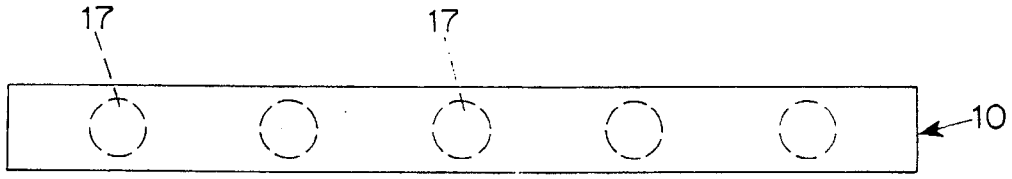
FIG. 2 is a diagrammatic top view of the wallet of FIG. 1, and illustrates the aperture sections for directing the marking material.

As seen in FIG. 2, looking down on the top of the container 10, one or more of the weaker aperture sections 17 may be located as shown. These aperture sections 17 are not necessarily circular; their shape is unimportant so long as they direct the dye 15 to spray out towards the thief upon activation. One or more aperture sections 17 may also be located in other parts of the container 10 to direct some of the dye to spray out in other directions, e.g. onto the valuable contents of the wallet.

Figure 4:
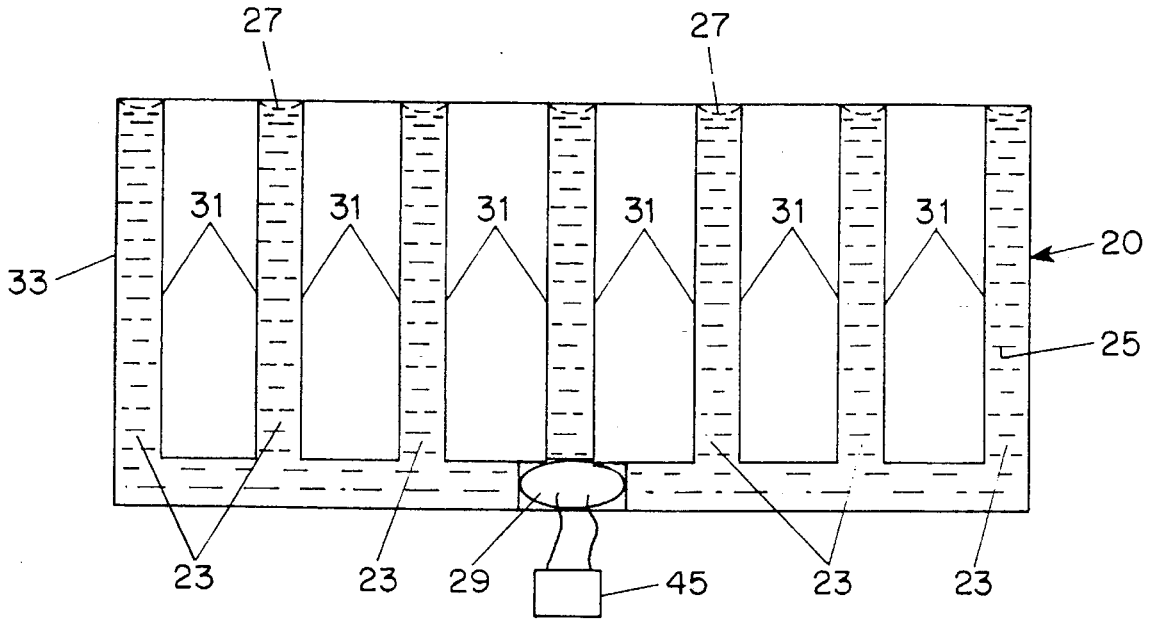
FIG. 4 is a diagrammatic side elevational view of a further embodiment of the anti-theft device according to the invention.

In an alternative embodiment of the invention, shown in FIG. 4, the dye 25 is contained in one or more passages 23 found in the container 20. These dye-filled passages 23 engage the explosive material 29. The explosive material 29 is positioned within, or proximate to the passages 23, such that detonation forces the dye 25 to spray out of a series of weaker aperture sections 27 similar to those previously described. The passages 23 may be formed by heat sealing together two sheets of thermoplastic material in the pattern shown to form heat seals at the walls 31 and 33. The aperture sections form the ends of the passages 23. The passages and the location of the aperture sections direct the marking material to spray out at a thief opening a closure 35.

The weaker aperture sections 17 or 27 of both the first and second embodiments shown in FIG. 1 and FIG. 4 respectively, may be of the same material as the walls of the container 10 or 20, weakened by stretching or heating, or they may be separable patches or the like of the same or different material forming closures to holes in the container.

Figure 6:
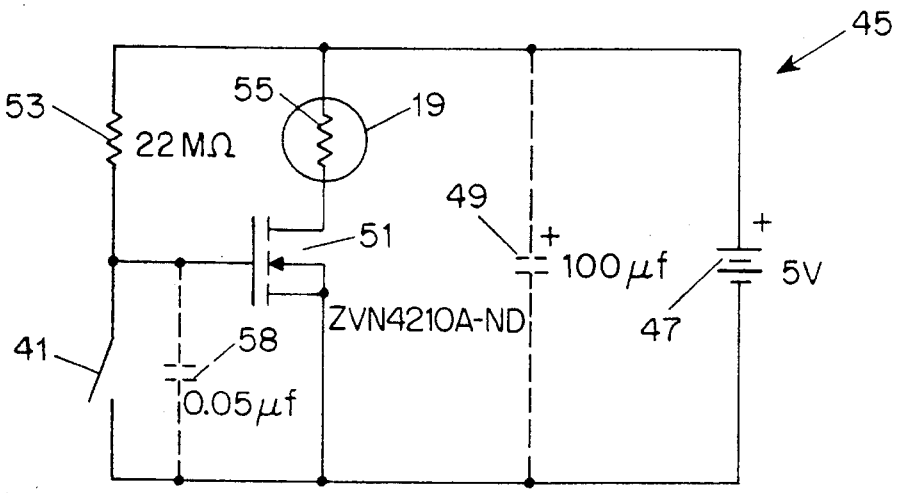
FIG. 6 is a schematic circuit diagram of one embodiment of an activating means.
Figure 7A:
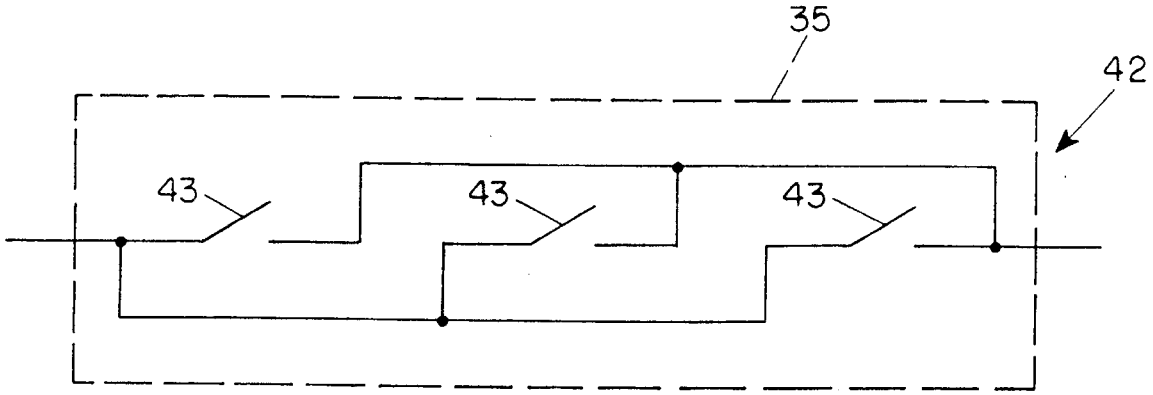
FIGS. 7(*a*), 7(*b*) and 7(*c*) are schematic circuit diagrams of three embodiments of a switch.
Figure 7B:
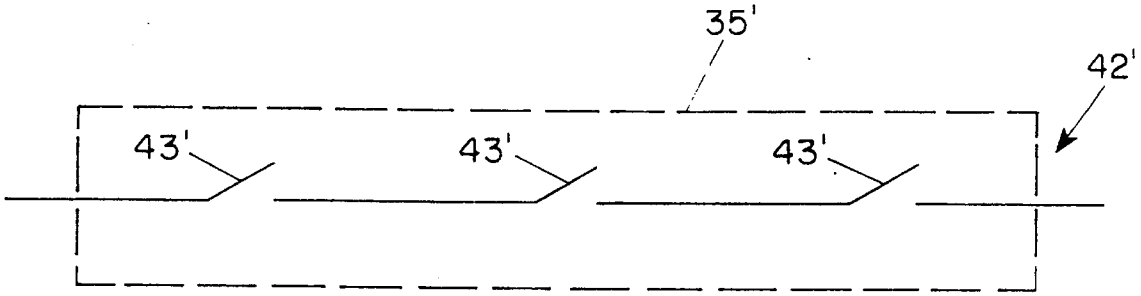
Figure 7C:
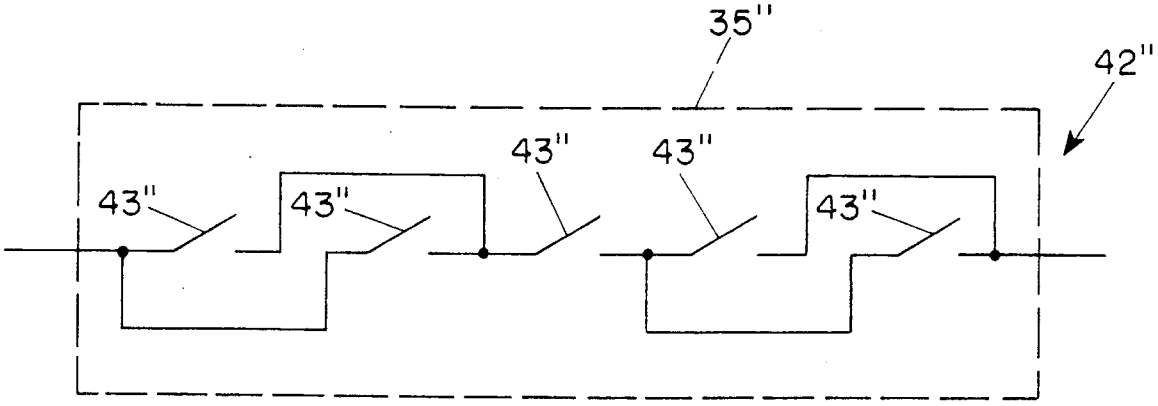

In FIG. 6 a preferred embodiment of a circuit 45 is shown which can be used as an activating means to detonate the explosive 19 or 29 when the closure 35 is opened. This particular circuit comprises a five volt battery 47, an optional 100 μf capacitor 49 (shown in broken lines in FIG. 6), a ZVN4210A-ND transistor 51, a resistive detonating element 55, a 22MΩ or greater resistor 53, and a closure incorporating a switch 41. The switch 41 may actually comprise several sub-switches 43 connected in series, or in parallel, or both, as shown in FIGS. 7(*a*), 7(*b*) and 7(*c*).

The circuit 45, shown in FIG. 6, is but one of many circuits which would work satisfactorily in the present invention. The important feature of the circuit is that it must send enough current through the resistive detonating element 55 to detonate the explosive 19 when the closure 35 is opened.

Figure 5:
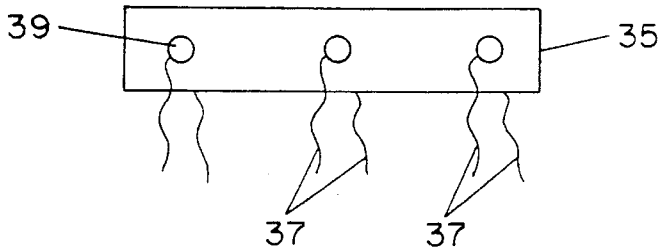
FIG. 5 is a diagrammatic side elevational view of one embodiment of a closure that, when opened, triggers activation.

In FIG. 5 the closure 35 is used for triggering the invention. The closure 35 has one or more electrical leads 37. These electrical leads 37 and the closure 35 form the switch 41 which connects to circuit 45 of FIG. 6.

In the embodiments of the invention shown, opening the closure 35 opens the switch 41, which causes the circuit 45 to detonate the explosive 19 or 29. Alternatively, it will be apparent that one may make an embodiment of the invention where opening the closure 35 would close a switch 41, and cause a different circuit to detonate an explosive or release a compressed gas.

In the circuit 45 shown, opening the closure 35, physically breaks electrical contact between both ends of the electrical leads 37. The electrical leads 37 may comprise separable contacts 39. These separable contacts 39 are physically separated when the closure 35 is opened, thus breaking electrical contact. The separable contacts 39 may be magnetic, and may themselves serve as the means for maintaining the closure closed. It is also possible that the electrical leads 37 could be designed spanning the closure 35 without separable contacts 39 to simply break when the closure is opened.

The degree to which the closure 35 must be opened to activate the explosive 19 may be chosen in a number of ways. This can be accomplished by changing the positions where the electrical leads 37 or subswitches 43 separate upon opening the closure 35. Also, series-connected switches arranged along the length of a closure as in FIG. 7(*b*) will permit activation by just opening of a single switch in just one portion of the closure. Switches arranged along the length of a closure, but connected in parallel as in FIG. 7(*a*), will require the closure to be opened more fully to open each switch and activate the explosive. Various combinations, such as that of FIG. 7(*c*), are possible as well.

In operation, referring again to the embodiment of the invention pictured in FIG. 1, when a thief opens the closure 35 of FIG. 5, electrical current ceases flowing through the electrical leads 37. The cessation of current through the electrical leads 37 causes the circuit 45 to redirect current through the resistive detonating element 55.

As happens in the activation of an automobile air bag, the energized resistive detonating element 55 then heats to detonate the explosive 19. This creates an explosively expanding gas 113, shown in FIG. 3. The explosively expanding gas 113 creates an overpressure in the container 10, which is transmitted to the flexible bladder 11. This overpressure causes the weaker aperture sections 17 to rupture. The pressure exerted on the compressed flexible bladder 11 causes the dye 15 to spray from the ruptured aperture sections 17 onto the thief who opened the closure 35.

The alternative embodiment of the invention shown in FIG. 4 operates in much the same way as the above-described embodiment shown in FIGS. 1 and 3, except that upon detonation of the explosive 29, by the circuit 45, the explosively expanding gas 113 (shown in FIG. 3), enters the passages 23. The pressure from the gas 113 forces the dye 25 to push against the weaker aperture sections 27 with enough force to cause them to rupture and spray out the dye 25 as in the embodiment of FIG. 3.

In both alternative embodiments of the invention, the container 10 or 20 may be so dimensioned as to fit within a wallet, purse, briefcase, handbag, personal computer carrier or the like.

The explosive 19 or 29 may be an azide or another suitable explosive. The explosive 19 or 29 may be replaced by any means for generating an overpressure. The dye 15 or 25 may be a liquid or a powder, and may also contain odiferous material. Alternatively, if desired, an odorant alone may replace the dye 15 or 25 as the marking material. The closure 35 is preferably held closed by synthetic materials that adhere when pressed together, which are commonly sold under the trademark "Velcro." However, the closure 35 may use any sort of fastener.

The separable contacts 39 are not essential, so long as the electrical conducting path across the switch 41 is broken when the closure 35 is opened. A circuit such as the one shown in FIG. 6 may incorporate a delay provision such as the capacitor 58 (indicated in broken lines in FIG. 6) to provide a slight delay between opening the closure 35 and detonating the explosive 19 or 29. Such a delay could help prevent accidental misfiring. Alternatively, if the closure were changed such that opening the closure would close a switch, a circuit could detonate the explosive when the switch was closed. Also, the circuit 45 may be located either inside the container as shown in FIG. 1, or outside the container as shown in FIG. 4.

Many other variations and modifications of the invention will be apparent to those skilled in the art without departing from the spirit and scope of the invention. The above-described embodiments are, therefore, intended to be merely exemplary, and all such variations and modifications are intended to be included within the scope of the invention defined in the appended claims.

What is claimed is:

1. A marking material-spraying anti-theft system, comprising:

(a) a closed flexible container having one or more weaker aperture sections adapted to break open when sufficient pressure develops within the container;

(b) a marking material positioned within the container, such that the marking material sprays out from the weaker aperture sections when the aperture sections break open;

(c) an overpressure generating means positioned within the container such that activation of the overpressure generating means produces sufficient pressure inside the container to break open one or more of the weaker aperture sections and spray the marking material out from the broken aperture sections;

(d) a closure which may be opened;

(e) an activating means responsive to opening the closure which activates the overpressure generating means when the closure is opened;

wherein the weaker aperture sections are positioned such that upon activation of the overpressure generating means, the spray of the marking material is directed towards a person opening the closure; and wherein the overpressure generating means is strong enough to spray the marking material out onto a person opening the closure, but weak enough to only break open the container at the weaker aperture sections.

2. The marking material-spraying anti-theft system according to claim 1, wherein the container is so dimensioned as to fit within a wallet, purse, briefcase, handbag, personal computer carrier or other carrier.

3. The marking material-spraying anti-theft system according to claim 2, wherein the closure is associated with a compartment in the wallet, purse, briefcase, handbag, personal computer carrier or other carrier.

4. The marking material-spraying anti-theft system according to claim 3, wherein the activating means is a circuit responsive to the opening of the closure to activate the overpressure generating means when the closure is opened.

5. The marking material-spraying anti-theft system according to claim 4, wherein the overpressure generating means is an explosive material.

6. The marking material-spraying anti-theft system according to claim 5, wherein the explosive material is an azide.

7. The marking material-spraying anti-theft system according to claim 5, wherein the container further comprises a bladder, the bladder separating the container into a first container section and a second container section, the first container section containing the marking-material and defining the weaker aperture sections, and the second container section containing the explosive material.

8. The marking-material spraying anti-theft system according to claim 5, wherein the container further comprises one or more passages containing the marking-material and having ends, each of the passages engaging the explosive material, and the weaker aperture sections forming the ends of the passages.

9. The marking material-spraying anti-theft system according to claim 1, wherein the marking material comprises a dye.

10. The marking material-spraying anti-theft system according to claim 1, wherein the marking material comprises an odorant.

11. The marking material-spraying anti-theft system according to claim 5, wherein the closure further comprises an electrical conductive path that conducts current when the closure is shut, but ceases to conduct electrical current when the closure is opened.

12. The marking material-spraying anti-theft system according to claim 5, wherein the activating means circuit includes a resistive heating element.

13. The marking material-spraying anti-theft system according to claim 11, wherein the conductive path comprises electrical leads each connected with a separable contact on the closure, which contacts separate to break electrical contact upon opening the closure.

14. The marking material-spraying anti-theft system according to claim 13, wherein the separable contacts comprise magnetic contacts.

15. The marking material-spraying anti-theft system according to claim 11, wherein the closure includes at least one parallel conductive path interruptable at differing locations to determine the amount of opening necessary to activate the explosive.

16. The marking material-spraying anti-theft system according to claim 15, wherein at least one of the parallel conductive paths is connected in series with a second conductive path.

17. The marking material-spraying anti-theft system according to claim 5, wherein the circuit includes a delay means for providing a delay between detecting the opening of the closure and detonating the explosive.

* * * * *